US006508061B2

(12) United States Patent
Stuttaford

(10) Patent No.: US 6,508,061 B2
(45) Date of Patent: Jan. 21, 2003

(54) DIFFUSER COMBUSTOR

(75) Inventor: Peter Stuttaford, Toronto (CA)

(73) Assignee: Pratt & Whitney Canada Corp, Quebec (CA)

( * ) Notice: Subject to any disclaimer, the term of this patent is extended or adjusted under 35 U.S.C. 154(b) by 0 days.

(21) Appl. No.: 09/840,991

(22) Filed: Apr. 25, 2001

(65) Prior Publication Data

US 2002/0157401 A1 Oct. 31, 2002

(51) Int. Cl.[7] ..... F02C 3/14
(52) U.S. Cl. ..... 60/804; 60/737
(58) Field of Search ..... 60/804, 737

(56) References Cited

U.S. PATENT DOCUMENTS 3,143,401 A * 8/1964 Lambrecht ..... 261/1
3,905,192 A * 9/1975 Pierce et al. ..... 239/402.5
4,845,952 A 7/1989 Beebe
5,161,366 A 11/1992 Beebe
5,452,574 A 9/1995 Cowell et al.
5,826,429 A 10/1998 Beebe et al.

* cited by examiner

*Primary Examiner*—Ehud Gartenberg
(74) *Attorney, Agent, or Firm*—Bachman & LaPointe, P.C.

(57) ABSTRACT

A combustion system for a power generating gas turbine engine which includes at least a combustion chamber with a annular fuel manifold at one end of the combustion chamber and a passageway having a narrow throat downstream of the fuel manifold whereby air passes around the fuel manifold and mixes with fuel and is diffused through the passageway into the burn zone defined in the combustion chamber in an ultimate location.

14 Claims, 2 Drawing Sheets

DIFFUSER COMBUSTOR

BACKGROUND OF THE INVENTION

1. Field of the Invention

The present invention relates to gas turbine engines and, more particularly, to an air/fuel mixer for a combustor. The type of gas turbine engine may be used in power plant applications.

2. Description of the Prior Art

Low NOx emissions from a turbine engine of below 10 volume parts per million (ppmv) are becoming an important criterion in the selection of turbine engines for power plant or aircraft applications. The current technology for achieving low NOx emissions involves a combination of a combustor with a fuel/air premixer. This technology is known as Dry-Low-Emissions (DLE) and offers the best prospect for clean emissions combined with high engine efficiency. The technology relies on a higher air content in the fuel/air mixture.

An air/fuel mixer is described in copending U.S. patent application Ser. No. 09/742,009, filed on Dec. 22, 2000, and assigned to the present applicant, which is herewith incorporated by reference. As described in that patent application, it is important to provide a uniform fuel/air mixture in the burn zone of a combustion chamber. The challenge is to achieve low emissions over different load conditions, yet obtain low cost of operation.

Although the above-mentioned application describes a particular fuel manifold assembly for a DLE system, it does not teach the environment in which the assembly would be used in a combustion chamber. For one thing, the burn zone should be located in a location within the chamber where the flame can be stabilized and to avoid coming into contact with the walls of the combustor can forming the chamber. It is also important to prevent cooling air from entering the burn zone formed in the combustion chamber.

SUMMARY OF THE INVENTION

It is an aim of the present invention to provide an improved fuel/air mix in a burn zone formed within the combustion chamber.

It is a further embodiment of the present invention to provide an air/fuel mixer using a fuel manifold instead of a nozzle.

It is a further aim of the present invention to provide a combustion chamber with a low power ignition stage and a second stage for full load combustion.

A combustion system in accordance with the present invention comprises a gas turbine engine having an annular cylindrical combustion casing with an inner wall and a radially spaced outer wall defining a combustion chamber, an annular air/fuel inlet at an end of the combustion casing, concentric with the inner and outer walls, a combustion chamber outlet downstream of the combustion chamber, the air/fuel inlet including a diffuser passageway formed between diffuser portions of the inner and outer walls respectively wherein each inner and outer diffuser wall portion has an upstream and a downstream portion relative to the air flow; the diffuser passageway formed by the adjacent inner and outer diffuser wall portions includes a converging cross-sectional section at the upstream portion of the inner and outer diffuser wall portions and a diverging cross-section at the downstream portion of the diffuser inner and outer wall portions and a throat is defined at the narrowest part of the passageway formed by the diffuser inner and outer wall portions; a concentric fuel manifold ring is provided upstream of the diffuser passageway whereby the manifold ring is located in axial alignment upstream of the diffuser passageway whereby air flows around the manifold ring and through the diffuser passageway mixing with fuel from the manifold ring and directed to a burn zone in the combustion chamber.

In a more specific embodiment of the present invention, the angle of the downstream portions of the diffuser inner and outer wall portions is selected to define the location of a burn zone in the combustion chamber.

Furthermore, in a yet more specific embodiment, the inlet may be offset relative to the inner and outer walls of the combustion casing in order to better locate the burn zone within the combustion chamber.

In a further embodiment of the present invention, a pair of annular air/fuel inlets is provided at the end of a combustion casing concentric with each other and with the inner and outer walls of the casing. The pair of annular air/fuel inlets includes an inner inlet adjacent the inner wall and an outer inlet adjacent the outer wall and an intermediate annular wall concentric with the inner and outer walls and located between the inner and outer inlets such that inner and outer combustion chambers are formed; each inner and outer air/fuel inlet including an inner and outer diffuser passageway respectively, wherein the outer passageway is formed between inner and intermediate diffuser portions of the outer and intermediate walls and wherein each outer and intermediate diffuser wall portion has an upstream and a downstream portion relative to the air flow; the inner passageway is formed between inner and intermediate diffuser portions of the inner and intermediate walls wherein each inner and intermediate diffuser wall portion has an upstream and a downstream portion relative to the air flow; the inner and outer diffuser passageways each include a converging cross-sectional section at the upstream portion of the diffuser wall portions and a diverging cross-section at the downstream portion of the diffuser wall portions and a throat is defined at the narrowest part of the passageway; and an inner and an outer concentric fuel manifold ring is provided upstream of each inner and outer diffuser passageway respectively whereby each inner and outer fuel manifold ring is located in axial alignment with the respective inner and outer diffuser passageway whereby the air flow flows around each manifold ring mixing with fuel from the respective inner and outer manifolds and through the respective inner and outer diffuser passageway and into the inner and outer combustion chamber respectively.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
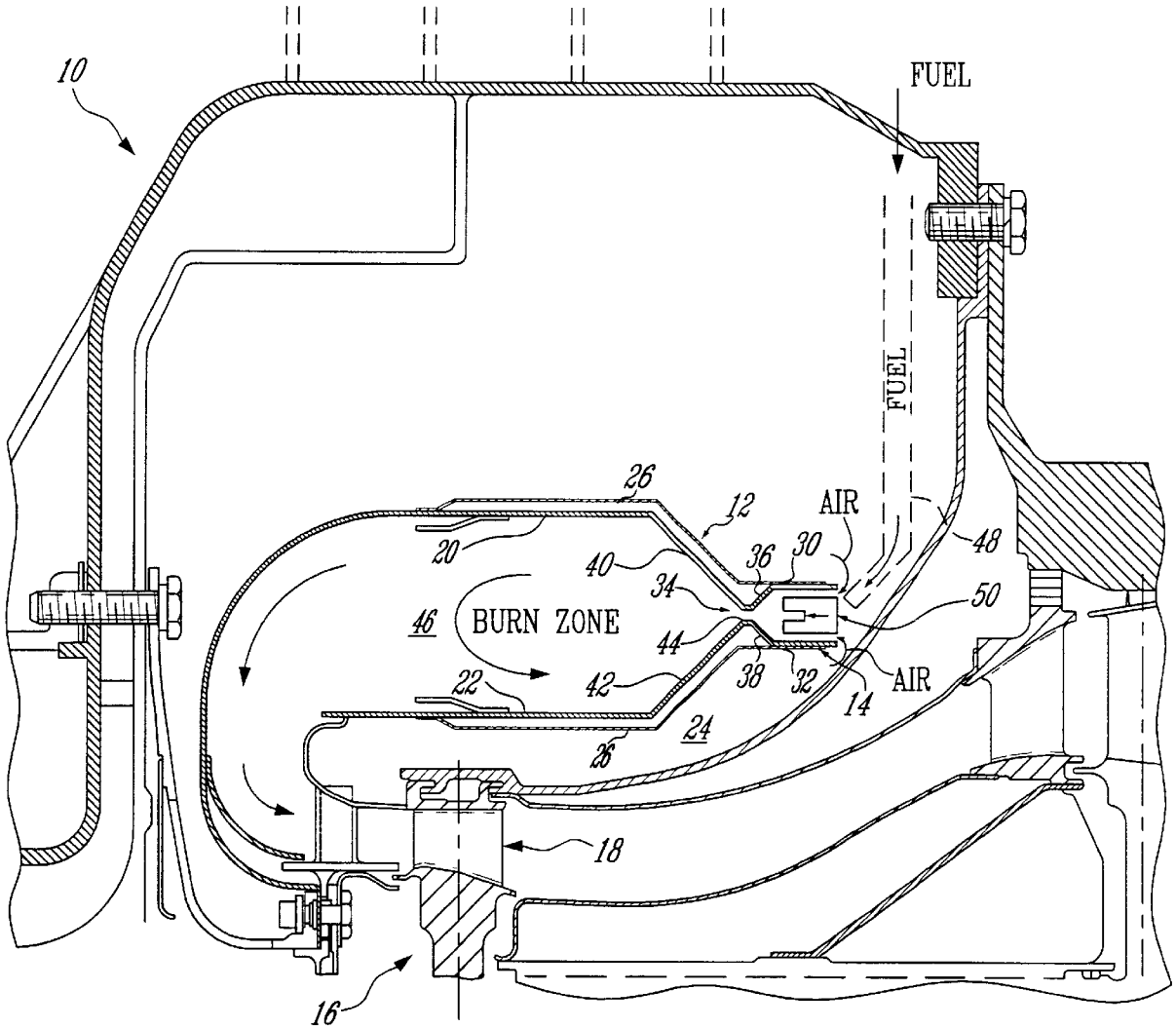
FIG. 1 is a schematic fragmentary axial cross-section showing the combustion section of a gas turbine engine in accordance with the present invention.

Referring now to the drawings, FIG. 1 shows an embodiment of a gas turbine engine used for a power plant application. An engine casing 10 is illustrated. The casing is cylindrical and surrounds an annular combustion can 12. The combustion can 12 has an inlet 14, and the combustion chamber 15 defined by the can 12 exhausts in a reverse direction through the turbine section 16 which includes a typical turbine wheel 18.

The combustion can 12 includes an outer cylindrical wall 20 and an inner concentric cylindrical wall 22. The annular combustion can 12 is surrounded by a cooling air space 24.

The inlet 14 is located axially at one end of the combustion can 12. The inlet is made up of a pair of spaced-apart inner and outer inlet wall portions 32 and 30 respectively. These inlet and outlet wall portions 32, 30 are extensions of the inner cylindrical wall 22 and outer cylindrical wall 20. An annular fuel manifold ring 50 is located in the annular space defined by the outer inlet wall 30 and inner inlet wall 32. Air flow space is provided around the fuel manifold ring 50, as will be described later.

The fuel manifold 50 is better described in copending U.S. patent application Ser. No. 09/742,009 and includes a fuel line 48 which communicates with an annular chamber within the manifold 50. A slotted axial opening is provided downstream of the ring, and typically fuel will pass through openings in the so-formed slot to migrate towards the downstream end of the manifold ring where it will be picked up by the shearing action of the air flow passing around the manifold 50 and heading downstream towards the passageway 34 formed between the outer inlet wall 30 and the inner inlet wall 32. The passageway 34 includes a throat 44 which is defined by upstream converging wall portions 36 and 38 and down stream diverging diffuser outer and inner wall portions 40 and 42 respectively. To define the throat area, the following formula should be followed:

$$M=ACd\sqrt{2\rho\Delta P}$$

wherein

M=mass flow

ACD=effective flow area

ρ=density of the air

ΔP=pressure drop

It is possible to relax the tolerance with respect to throat 44 by including airholes between inlet 14 and manifold 50.

Thus, the air, which represents 97% of the fluid passing through the passageway 34 and the fuel being mixed with the air presents a homogeneously mixed air/fuel fluid in the burn zone 46 defined centrally within the combustion chamber 15. The burn zone 46 is located in an area spaced from the inner and outer combustor walls 20 and 22. This is accomplished by specifically selecting the angle of the diffuser walls 40 and 42 as well as locating the inlet 14 offset from the center line of the combustion chamber 15. Thus, the inlet will be selected by locating the inlet and by arranging the angle of walls 40 and 42 to arrive at the best location for the burn zone 46 in a given engine.

The burn zone 46 in the combustion chamber is kept cool by providing impingement liners 26 on the exterior of the outer and inner walls 20 and 22 of the combustion can 12. This enables the combustion process to be controlled and to avoid wall quenching.

Figure 2:
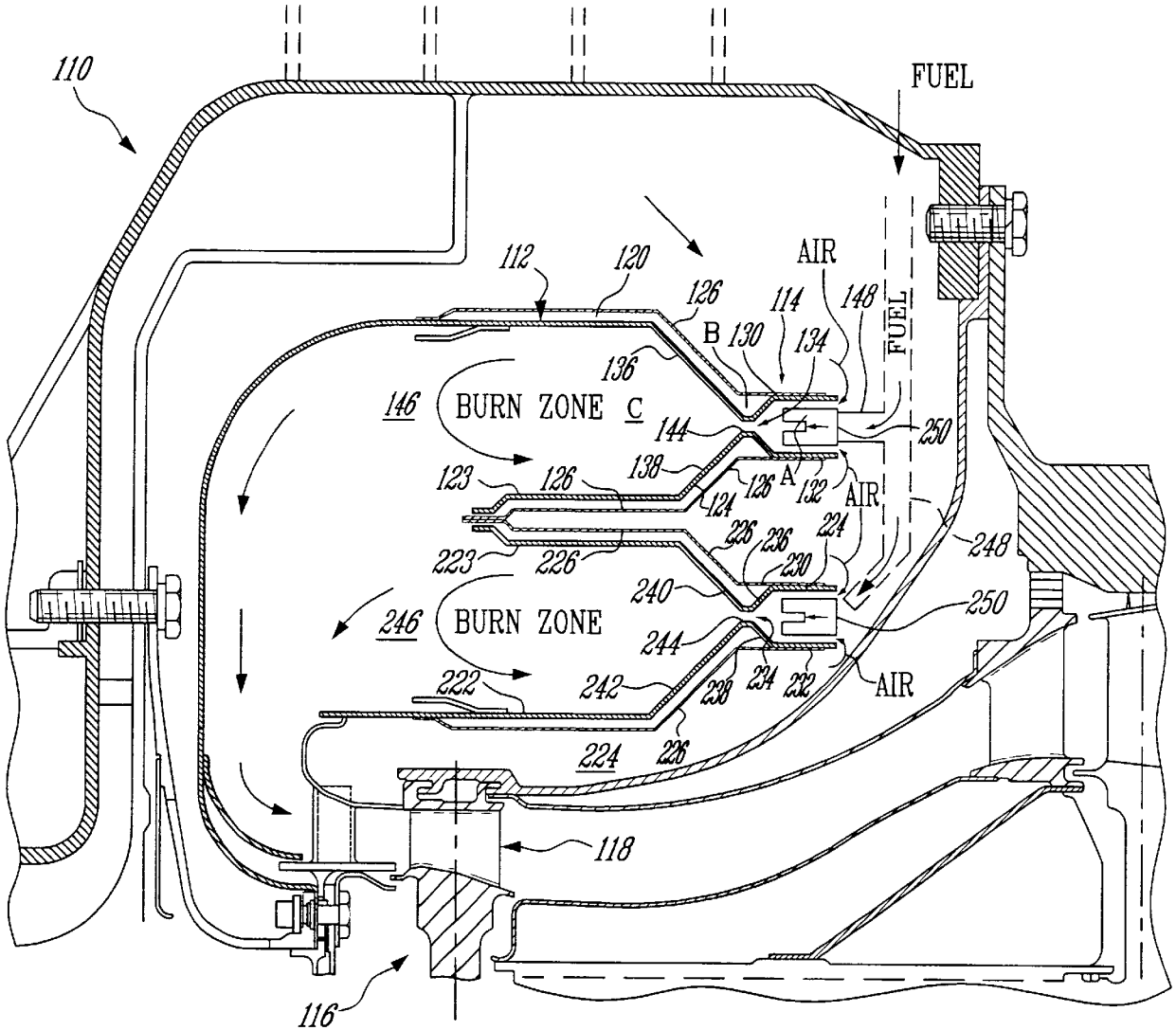
FIG. 2 is a fragmentary axial cross-section, similar to FIG. 1, but showing another embodiment thereof.

Referring now to the embodiment shown in FIG. 2, a double combustion chamber 112 is illustrated as being within an engine casing 110. In this case, there is an outer burn zone 146 and an inner burn zone 246 which is created and separated by intermediate walls 123 and 223. Thus, the outer wall of the combustion chamber is illustrated at 120, and the inner combustor wall is illustrated at 222.

Likewise, there are two inlets 114 and 214 which are concentric to each other as well as to the combustion chamber walls 120 and 222. Impingement liners 126 and 226 are also strategically located to surround the intermediate walls 123 and 223 as well as the inner wall 120 and outer wall 222. The air space 124 and 224 surrounds the two combustion chamber sections.

The outer inlet 114 includes outer inlet wall segment 130 and intermediate inlet wall portion 132 defining a passageway 134 with converging inlet wall portions 136 and 138. Similarly, there are diverging diffuser inlet wall portions 136 and 138. Finally, the fuel manifold ring 150 is fed by fuel line 148 and is set upstream of passageway 134.

The main inlet 214 has a similar construction with inner inlet wall segment 232 and intermediate inlet wall segment 230 defining passageway 234. The fuel manifold ring 250 is located upstream of inlet 234.

The provision of two annular combustion chambers, such as in the embodiment of FIG. 2, operates as follows. The outer combustion chamber 115 includes fuel manifold 150 and is used to light and operate the engine below approximately 60% load capacity. To accelerate the engine to full load, the inner combustion chamber 215 includes fuel manifold 250 which is then supplied by fuel, and the fuel/air mixture so formed will ignite, due to the burning process in the outer combustion chamber 115. This allows the combustor to operate with literally no quenching effects and providing low CO emissions at low power. The ignition and mainstage might be reversed depending on the operating requirements of the combustor.

I claim:

1. A combustion system for a gas turbine engine having an annular cylindrical combustion can with an inner wall and a radially spaced outer wall defining a combustion chamber, an annular air/fuel inlet at an end of the combustion can, concentric with the inner and outer walls, a combustion chamber outlet downstream of the combustion chamber, the air/fuel inlet including a diffuser passageway formed between diffuser wall portions of the inner and outer walls respectively wherein each inner and outer diffuser wall portion has an upstream and a downstream portion relative to the air flow; the diffuser passageway includes a converging cross-sectional section at the upstream portion of the inner and outer diffuser wall portions and a diverging cross-section at the downstream portion of the diffuser inner and outer wall portions and a throat is defined at the narrowest part of the passageway formed by the inner and outer diffuser wall portions; a fuel manifolding is provided upstream of the diffuser passageway whereby the manifold ring is located in axial alignment with the diffuser passageway and concentric therewith whereby the air flows around the manifold ring, and through the diffuser passageway mixing with fuel from the manifold ring and directed to a burn zone in the combustion chamber.

2. The combustion system as defined in claim 1, wherein the downstream portions of the diffuser inner and outer wall portions have diverging angles which are selected as a function of the location of the burn zone.

3. The combustion system as defined in claim 1, wherein the annular air/fuel inlet is offset relative to the inner and outer walls as a function of the location of the burn zone.

4. A combustion system as defined in claim 1, wherein the fuel manifold ring includes a front face on the downstream side thereof and an annular channel is defined in the front face and fuel outlets are provided in the channel so that fuel will migrate along the channel to be sheared and mixed with the air flow.

5. A combustion system for a gas turbine engine comprising an annular cylindrical combustor can with an outer wall and an inner wall, including a pair of annular air/fuel inlets provided at the end of the combustor can concentric with each other and with the inner and outer walls of the combustor can, the pair of annular air/fuel inlets including an inner inlet adjacent the inner wall and an outer inlet adjacent the outer wall and an intermediate annular wall concentric with the inner and outer walls and located between the inner and outer inlets such that inner and outer combustion chambers are formed; each inner and outer air/fuel inlet including an inner and outer diffuser passageway respectively, wherein the outer passageway is formed between the outer and intermediate diffuser portions of the outer and intermediate walls and wherein each outer and intermediate diffuser wall portion has an upstream and a downstream portion relative to the air flow; the inner passageway is formed between inner and intermediate diffuser portions of the inner and intermediate walls wherein each inner and intermediate diffuser wall portion has an upstream and a downstream. portion relative to the air flow; the inner and outer diffuser passageways each include a converging cross-sectional section at the upstream portion of the diffuser wall portions and a diverging cross-section at the downstream portion of the diffuser wall portions and a throat is defined at the narrowest part of the passageway; and an inner and an outer concentric fuel manifold ring are provided upstream of each inner and outer diffuser passageway respectively, such that each inner and outer fuel manifold ring is located in axial alignment with the respective inner and outer diffuser passageway, whereby the air flow passes around each manifold ring mixing with fuel from the respective inner and outer manifolds and through the respective inner and outer diffuser passageways and into the inner and outer combustion chamber respectively.

6. A combustion system as defined in claim 5, wherein the combustion chambers merge beyond the intermediate wall defining the inner and outer combustion chambers.

7. A combustion system as defined in claim 5, wherein one of the inner and outer combustion chambers is ignited when lower power is required and the other of the inner and outer combustion chambers is ignited when substantial power is required.

8. A gas turbine engine having a compression system, a combustion system and a power extraction system, the combustion system including;

an annular cylindrical combustion can defining at least one combustion chamber zone having inner and outer walls, an annular air/fuel inlet at an upstream end of the at least one combustion zone and concentric with the inner and outer walls, a combustion chamber outlet downstream of the at least one combustion chamber zone, the air/fuel inlet including a diffuser passageway formed between inner and outer diffuser wall portions of the inner and outer walls respectively, wherein each inner and outer diffuser wall portion has an upstream and a downstream portion relative to an air flow through the combustion can;

the diffuser passageway includes a converging cross-sectional section at the upstream portion of the inner and outer diffuser wall portions and a diverging cross-section at the downstream portion of the diffuser inner and outer wall portions and a throat defined at a narrowest part of the passageway formed by the inner and outer diffuser wall portions; and a fuel manifold ring provided upstream of the diffuser passageway and located in axial alignment with the diffuser passageway and concentric therewith, whereby air flowing around the manifold ring and through the diffuser passageway mixes with fuel from the manifold ring and is directed to a burn zone in the combustion can.

9. A gas turbine as defined in claim 8, wherein downstream portions of the diffuser inner and outer wall portions have diverging angles which are selected as a function of the location of the burn zone.

10. A gas turbine as defined in claim 8, wherein the annular air/fuel inlet is offset relative to the inner and outer walls as a function of the location of the-burn zone.

11. A gas turbine as defined in claim 8, wherein the fuel manifold ring includes a front face on the downstream side thereof and an annular channel is defined in the front face and fuel outlets are provided in the channel so that fuel will migrate along the channel to be sheared and mixed with the air flow.

12. A gas turbine engine as defined in claim 8 wherein the first combustion zone is as described in claim 8 and wherein a second combustion chamber zone is defined between second chamber inner and outer walls concentric with the inner and outer walls of the said first combustor portion, the second combustion chamber zone including a second annular air/fuel inlet provided at an upstream end of the second combustion chamber zone and concentric with said first annular air/fuel inlet, the second air/fuel inlet including a second diffuser passageway formed between second chamber inner and outer diffuser wall portions of the second chamber inner and outer walls, wherein each of the second chamber inner and outer diffuser wall portions has an upstream and a downstream portion relative to the said air flow;

the second diffuser passageway includes a converging cross-sectional section at the upstream portion of the second chamber diffuser wall portions and a diverging cross-sectional section at the downstream portion of the second chamber diffuser wall portions and a second throat defined at a narrowest part of the second diffuser passageway; and a second fuel manifold ring provided upstream of the second diffuser passageway, such that the second fuel manifold ring is concentric with the said first fuel manifold ring and is located in axial alignment with the second diffuser passageway, whereby an air flow passing around the said first and second manifold rings mixes with fuel from the respective first and second manifold rings and passes through the respective first and second diffuser passageways and into the said first and second combustion chamber zones respectively.

13. A gas turbine as defined in claim 12, wherein the first and second combustion chamber zones merge at a downstream portion of the combustor can.

14. A gas turbine as defined in claim 12, wherein the first and second combustion chambers are operable independent of one another.

* * * * *

UNITED STATES PATENT AND TRADEMARK OFFICE

CERTIFICATE OF CORRECTION

PATENT NO. : 6,508,061 B2
DATED : January 21, 2003
INVENTOR(S) : Peter Stuttaford It is certified that error appears in the above-identified patent and that said Letters Patent is hereby corrected as shown below:

Column 4,
Line 48, delete “manifolding” and insert -- manifold ring --

Column 6,
Line 17, delete “the-burn” and insert -- the burn --

Signed and Sealed this

Eighteenth Day of March, 2003

JAMES E. ROGAN
*Director of the United States Patent and Trademark Office*